US010352020B2

(12) United States Patent
O'Connor et al.

(10) Patent No.: US 10,352,020 B2
(45) Date of Patent: Jul. 16, 2019

(54) SAFETY COUPLING MECHANISM

(71) Applicant: Geith International Limited, County Meath (IE)

(72) Inventors: Damien O'Connor, County Meath (IE); Girard Yves, County Meath (IE); Martin McCormack, County Meath (IE)

(73) Assignee: Geith International Limited, Co.Meath (IE)

( * ) Notice: Subject to any disclaimer, the term of this patent is extended or adjusted under 35 U.S.C. 154(b) by 576 days.

(21) Appl. No.: 14/913,502

(22) PCT Filed: Aug. 20, 2014

(86) PCT No.: PCT/EP2014/067769

§ 371 (c)(1),
(2) Date: Feb. 22, 2016

(87) PCT Pub. No.: WO2015/024981

PCT Pub. Date: Feb. 26, 2015

(65) Prior Publication Data

US 2016/0201290 A1 Jul. 14, 2016

(30) Foreign Application Priority Data

Aug. 23, 2013 (GB) ..... 1315126.1

(51) Int. Cl.
*E02F 3/00* (2006.01)
*E02F 3/36* (2006.01)
*E02F 9/26* (2006.01)

(52) U.S. Cl.
CPC ..... *E02F 3/365* (2013.01); *E02F 3/364* (2013.01); *E02F 3/3622* (2013.01);
(Continued)

(58) Field of Classification Search
CPC ..... E02F 3/3622; E02F 3/3627; E02F 3/364; E02F 3/3645; E02F 3/365; E02F 3/3672; E02F 9/26; Y10T 403/593; Y10T 403/59
See application file for complete search history.

(56) References Cited

U.S. PATENT DOCUMENTS 5,332,353 A * 7/1994 Arnold ..... E02F 3/3622 172/275
6,058,633 A * 5/2000 Barden ..... E02F 3/3618 37/468

(Continued)

FOREIGN PATENT DOCUMENTS

EP 1138833 10/2001 ..... E02F 3/36
EP 1900880 3/2008 ..... E02F 3/36

(Continued)

OTHER PUBLICATIONS

International Search Report from corresponding International Patent Application No. PCT/EP2014/067769, dated Dec. 22, 2014.

(Continued)

*Primary Examiner* — Matthew R McMahon
(74) *Attorney, Agent, or Firm* — Kusner & Jaffe

(57) ABSTRACT

An excavator tool attaching mechanism includes a housing having a pair of housing walls; a fixed engagement member for engaging with a first coupling pin of an excavator tool; a moveable engagement mechanism for engaging with a second coupling pin of the excavator tool; and a safety mechanism moveable between a locked and an unlocked configuration. The moveable engagement mechanism includes an engaging element moveable between a first position for releasing the excavator tool and a second position for engagement with the second coupling pin. The safety mechanism is automatically moved from the unlocked to the locked configuration by movement of the engaging element from the first to the second position, preventing (Continued)

movement of the engaging element between the second and first position. The engaging element is moveable to the second position when the moveable engagement mechanism engages with the second coupling pin.

16 Claims, 11 Drawing Sheets

(52) U.S. Cl.
CPC ..... *E02F 3/3645* (2013.01); *E02F 3/3672* (2013.01); *E02F 9/26* (2013.01); *Y10T 403/59* (2015.01); *Y10T 403/593* (2015.01)

(56) References Cited

U.S. PATENT DOCUMENTS

| | | | | |
|---|---|---|---|---|
| 6,422,805 | B1 * | 7/2002 | Miller | E02F 3/3618 37/468 |
| 6,691,438 | B2 * | 2/2004 | Fatemi | E02F 3/3627 37/403 |
| 7,086,821 | B1 * | 8/2006 | Reicks | E02F 3/3622 37/468 |
| 8,585,345 | B2 * | 11/2013 | Sikorski | E02F 3/3618 414/723 |
| 9,206,582 | B2 * | 12/2015 | Doherty | E02F 3/3618 |
| 2013/0160268 | A1 * | 6/2013 | Parker | E02F 3/3618 29/428 |
| 2013/0164080 | A1 | 6/2013 | Miller et al. | 403/327 |
| 2015/0259874 | A1 * | 9/2015 | Cunningham | E02F 3/3618 403/52 |

FOREIGN PATENT DOCUMENTS

| | | | |
|---|---|---|---|
| EP | 2055842 | 5/2009 | E02F 3/36 |
| IE | 20050169 | 10/2005 | E02F 3/36 |
| JP | S53 I09304 | 9/1978 | E02F 3/36 |

OTHER PUBLICATIONS

Written Opinion of the International Searching Authority from corresponding International Patent Application No. PCT/EP2014/067769, dated Dec. 22, 2014.

* cited by examiner

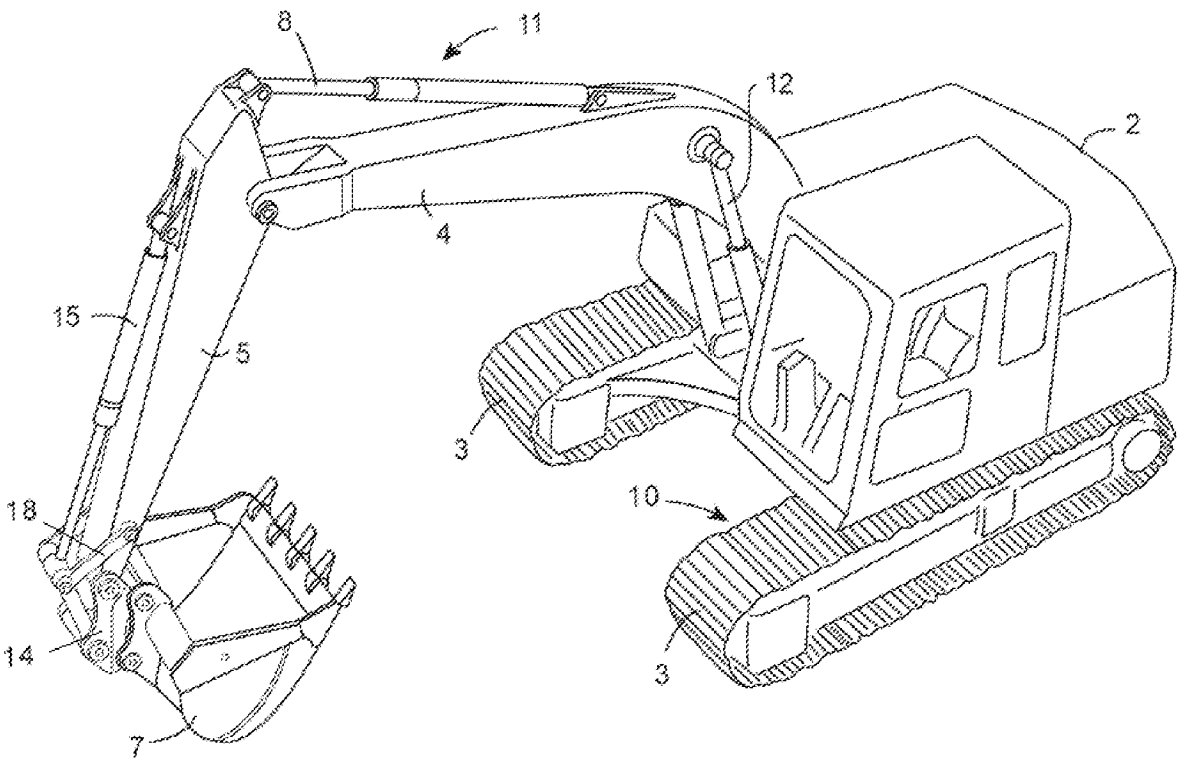
Figure 1 - Prior Art

SAFETY COUPLING MECHANISM

FIELD OF THE INVENTION

The present invention relates to a locking mechanism for use in a quick hitch coupling device for coupling an attachment to a mechanical arm of, for example, an excavator. More particularly, but not exclusively, the present invention relates to a locking mechanism for a quick hitch coupling device comprising a safety system in which an operator releases a safety lock and retracts an engaging plate with the aid of a release tool.

BACKGROUND TO THE INVENTION

Coupling devices for coupling accessories to hydraulically operated arms of excavator machinery are well known. These devices are typically used to attach different types of attachments to a mechanical arm (commonly referred to as the "dipper arm") of such apparatus. Such attachments may include, but are not limited to, a rock breaker, or different sizes of buckets.

The coupling device (also commonly referred to as a "coupler" or "quick hitch") is usually releasably attachable to both the (dipper) arm of an excavator and the attachment. The quick hitch is adapted for attachment to the arm and normally would remain on the arm and be utilised to interchangeably couple different attachments to the arm. Typically, quick hitches come in one of two configurations: "pin couplers", and "dedicated couplers".

Dedicated couplers are usually configured to interact only with attachments bearing complementary components, these complementary components often comprising combinations of plates and holes. Pin couplers, on the other hand, are designed to work in conjunction with any attachment bearing a pair of spaced apart coupling pins typically used for connecting to arms. Pin couplers comprise a body member adapted for coupling to the arm, and a pair of engagement members that are provided for releasably engaging the pair of spaced apart coupling pins located on the attachment. One engagement member typically is moveable relative to the other engagement member between an engaged state and a disengaged state. In the engaged state, the engagement members co-operate such that each engagement member securely engages a respective coupling pin, thereby securely coupling the attachment to the dipper arm. In the disengaged state, the engagement members are positioned relative to one another such that the coupling pins are not securely engaged, and the attachment can thereby be released from the dipper arm. The engagement members are formed, for example, by a set of hooks, typically at least two hooks. Typically, the moveable engagement member is either slideably or pivotally connected to the body member and is moveable between the engaged and disengaged states by a ram, for example, a hydraulic means such as a hydraulic ram, or by mechanical means, such as a ram comprising a screw threaded piston, a linkage or a lever. Pin couplers comprising hydraulic means, and dedicated couplers analogously comprising hydraulic means will herein be referred to as "hydraulic couplers", whereas pin couplers comprising mechanical means, and dedicated couplers analogously comprising mechanical means will herein be referred to as "mechanical couplers".

Pin couplers and dedicated couplers suffer from a number of disadvantages.

To avoid the inadvertent or accidental release of the attachment by releasing the grip of the coupler on the attachment, locking systems have been incorporated into existing coupling systems to ensure that the attachment is only released when it is desired to do so. Mechanical locks have been provided on couplers that require the operator of the machine (or another person) to manually release the mechanical lock. Such mechanical locks have been provided in both mechanical and hydraulic couplers. However, the operator must get out of the excavator machine to operate the lock, and this is not always done. A problem therefore arises when the operator of the excavator neglects to engage the lock after connecting an attachment to an excavator arm.

Irish Patent Number 2005/0169 discloses a quick attachment device in which a safety lock may be engaged and disengaged by an operator, however manual intervention on behalf of a user is required to engage and disengage the lock. Furthermore, the lock may close even when there is no attachment secured in place. It would be preferable to provide an attachment device which overcomes the drawbacks outlined above.

SUMMARY OF THE INVENTION

An embodiment of a first aspect of the invention comprises an excavator tool attaching mechanism comprising a housing comprising a pair of housing walls; a first fixed engaging means for engaging with a first retaining element of an excavator tool; a second moveable engaging means for engaging with a second retaining element of the excavator tool; a safety mechanism moveable between a locked and an unlocked configuration; wherein the second engaging means comprises an engaging element moveable between a first position for releasing an excavator tool and a second position for engagement with a retaining element of the excavator tool; such that the safety mechanism is automatically moved from the unlocked to the locked configuration by movement of the engaging element from the first to the second position, preventing movement of the engaging element between the second and first position; and wherein the engaging element is moveable to the second position when the second engaging element engages with a retaining element of an excavator tool.

As such, the engaging element will not move into the second position without the safety mechanism also moving into a locked configuration. No additional manual intervention is required to move the safety mechanism. Furthermore, this action is not possible unless the engaging element of the attaching mechanism is positioned in order to receive or engage with a retaining element of an excavator tool. A further advantage is that the engaging element is moveable to the second position only when the second engaging element engages with a retaining element of an excavator tool. This is advantageous, as it follows that it would not be possible to have the safety mechanism in a locked configuration without an excavator tool in place. Furthermore, it follows that it would not be possible for an operator to inadvertently lock the safety mechanism without a retaining element of an excavator tool in place.

The attaching mechanism may further comprise a ramp element fixed to the engaging element. This has the advantage of allowing for easier engagement between the engaging element and a retaining element of an excavator tool.

The engaging element may be moveable between the first position and the second position by engagement of the ramp element with a retaining element of the excavator tool. The operator of an excavator may perform this action by manoeuvring the ramp element in relation to the excavator tool. Hence, the action may be performed without an operator having to leave the cab of the excavator.

The engaging element of the attaching mechanism may comprise an engagement plate slideable between the housing walls. This provides a robust overall structure to the mechanism.

The safety mechanism of the attaching mechanism may be housed within the engaging element of the second engaging means. This allows for the movement of the engaging element to co-operate with the operation of the safety mechanism.

The engaging element of the attaching mechanism may further comprise a raised portion on the engagement plate. The raised portion provides a surface upon which to apply a force suitable to move the engaging element between the housing walls.

The safety mechanism may be housed within the raised portion on the engagement plate. This allows for the movement of the engaging element to co-operate with the operation of the safety mechanism and further allows for ease of access to the safety mechanism for an operator.

The safety mechanism may further comprise a biased pin engagable with one of the housing walls. This allows the safety mechanism to influence movement of the engaging element relative to the housing.

The pin of the safety mechanism may be accessible through an opening in the engaging element. The pin may be accessible through an opening in a raised portion of the engagement element. This provides the advantage of providing ease of access to the pin for an operator of the mechanism. It also allows an operator to visually inspect the position of the pin.

The safety mechanism may be moveable between the locked and unlocked positions by means of a tool engageable with the safety mechanism. The tool may be further engageable with the engaging element such that the engaging element is moveable between the second and first positions. This allows the safety mechanism to be manually changed from the locked to the unlocked configuration by an operator using a suitable tool. Furthermore, the engaging element may be moved from the second position for engagement with a retaining element of the excavator tool and the first position for releasing the excavator tool.

The engaging element of the attaching mechanism may be moveable to a third position, between the first and the second positions, by means of a tool engageable with the second engaging means and the safety mechanism and wherein the engaging element is held in the third position by a retaining means which prevents the engaging element from moving between the first and the second positions. This has the advantage of maintaining the engaging element in a third position between the first position for releasing an excavator tool and the second position, where a tool is engaged. In the third position, the engaging element is suitably positioned to be engaged with the retaining element of an excavator tool.

The retaining means for holding the engaging element in the third position may comprise a biased link on the engaging element of the second engaging means which engages with a recess in one of the housing walls. The biased link may be biased by means of a tension spring.

The attaching mechanism may further comprise an indicator for indicating the position of the engaging element. This provides the advantage of allowing an operator to visually confirm the position of the engaging element and thus deduce if an excavator tool is attached or detached. The visual confirmation may be performed without leaving the cab of the excavator.

The attaching mechanism of any preceding claims may be incorporated into a coupling device for coupling an excavator tool to an arm. Furthermore, an excavator arm may comprise the attaching mechanism.

BRIEF DESCRIPTION OF THE DRAWINGS

FIG. 1 is a perspective view of an excavator comprising a dipper arm as is known in the art.

DETAILED DESCRIPTION OF THE DRAWINGS

Figure 2A:
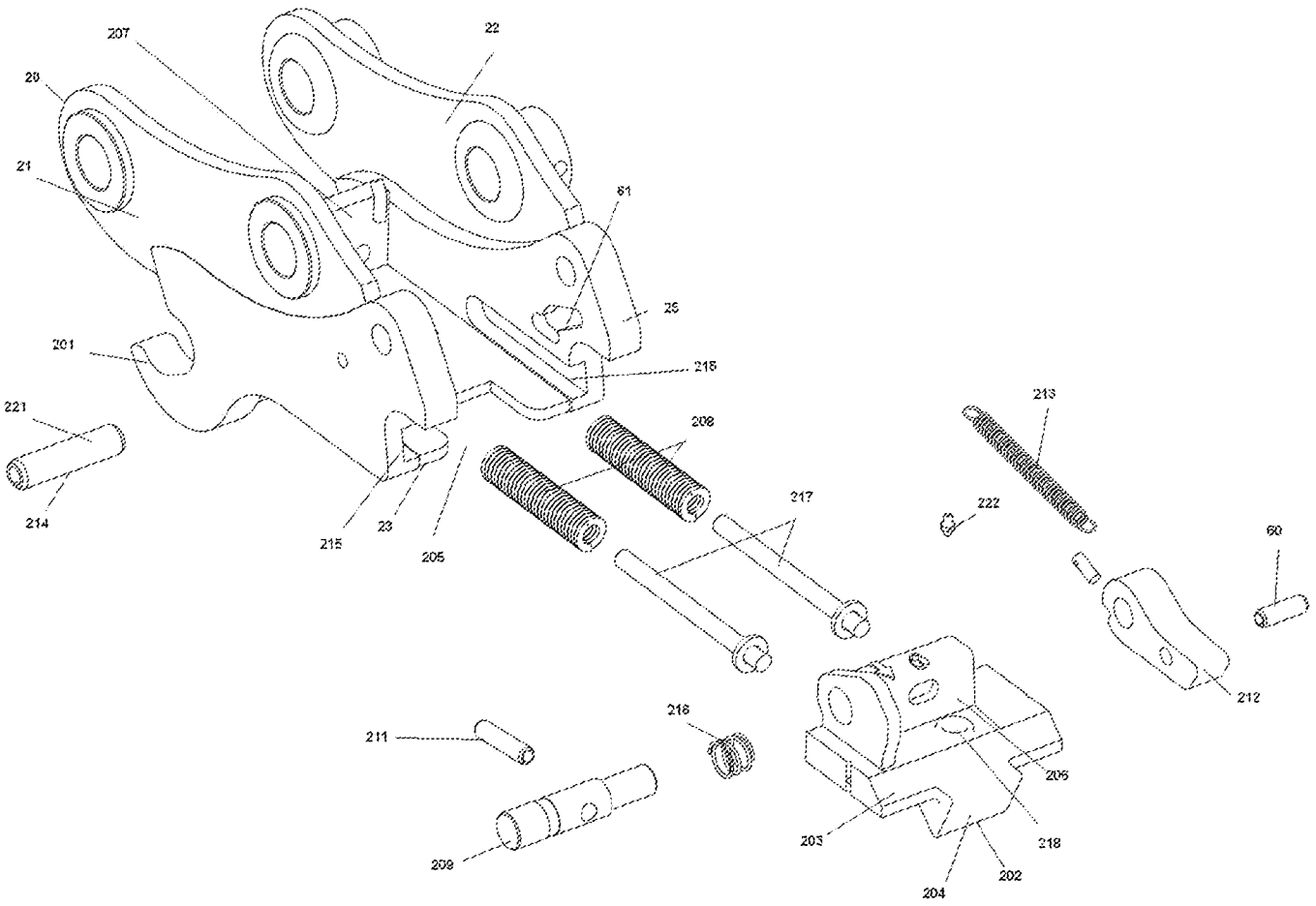
FIG. 2A is an exploded view of the mechanism showing its component parts.
Figure 2B:
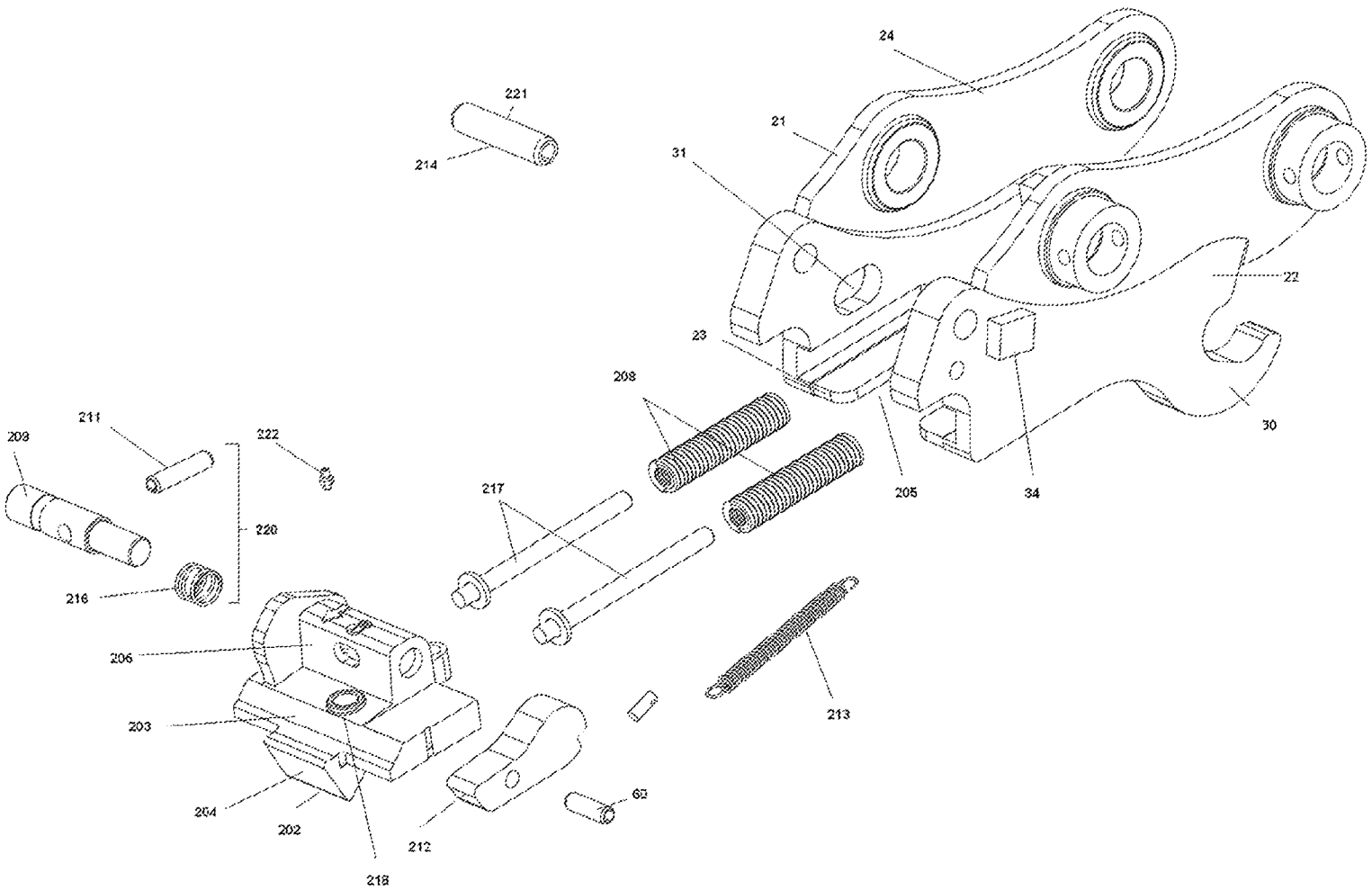
FIG. 2B is an exploded view of the mechanism showing its component parts.
Figure 3A:
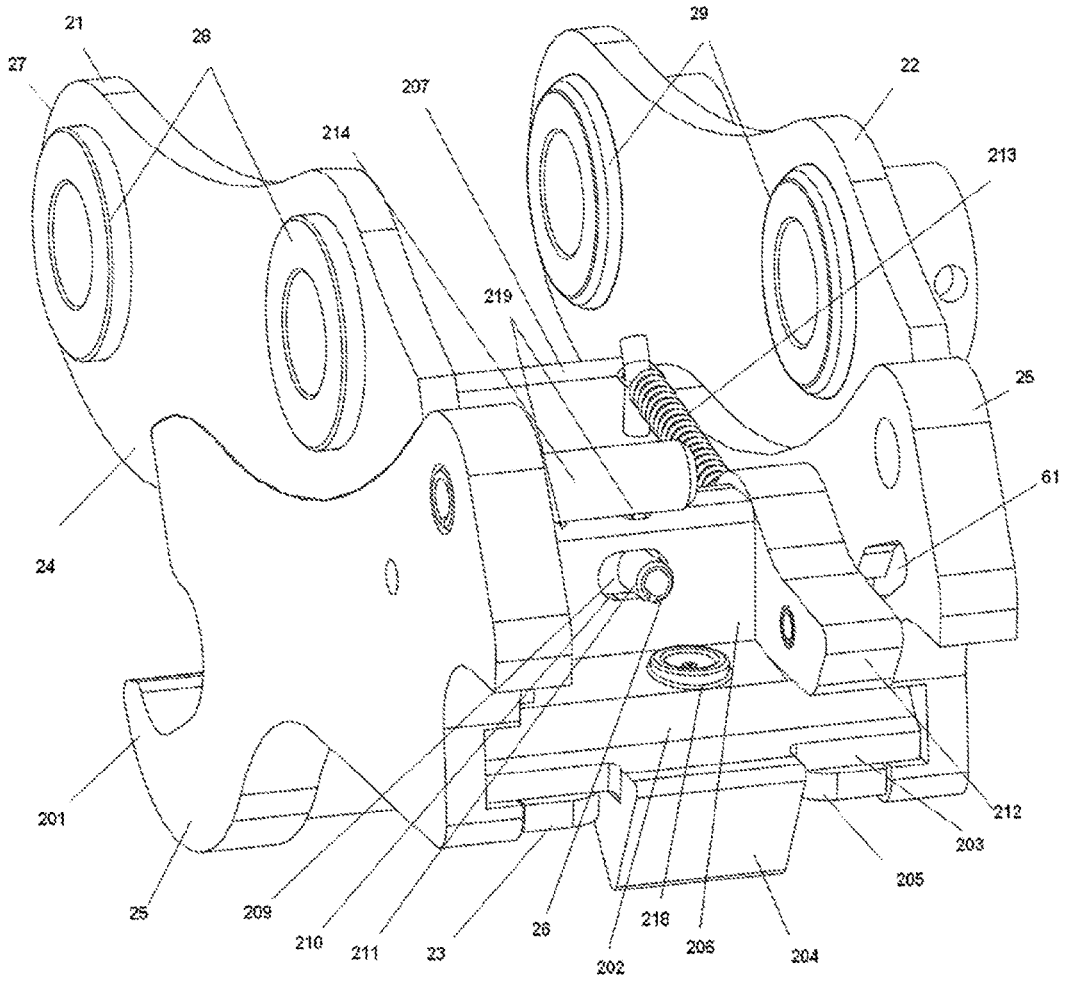
FIG. 3A is a perspective view of the mechanism in a closed configuration with the release tool disengaged.
Figure 3B:
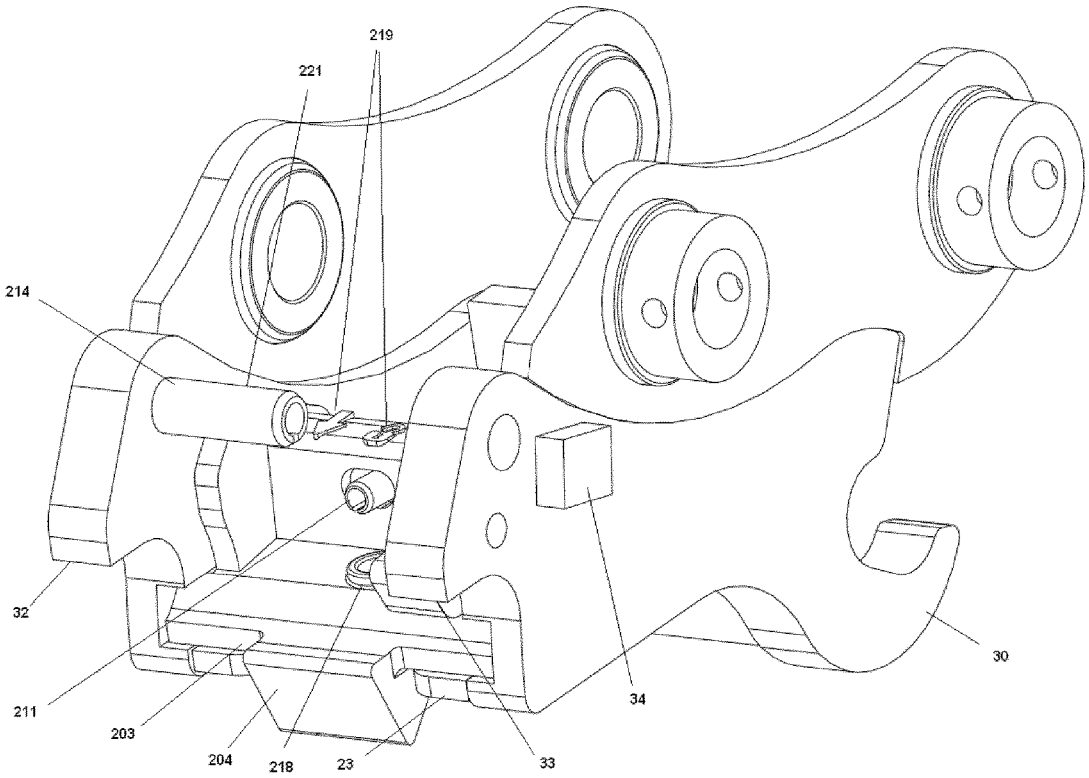
FIG. 3B is a perspective view of the mechanism in a closed configuration with the release tool disengaged.

Referring to the drawings and initially to FIG. 1, there is illustrated an excavator apparatus according to the invention indicated generally by the reference numeral 10. The apparatus 10 comprises a main housing 2 that is carried on a main chassis, which in turn is carried on ground engaging tracks 3. The main housing 2 is mounted on a sub-housing that is rotatably carried on the main chassis 3 about a vertically extending axis, so that the sub-housing and the main housing 2 are rotatable through 360° relative to the main chassis. This aspect of such excavator apparatus will be well known to those skilled in the art. A back actor arm 11 is mounted on the sub-chassis and comprises a boom 4 that is pivotally connected to the sub-chassis and extends upwardly therefrom. A dipper arm 5 is pivotally carried on the boom 4 for in turn pivotally carrying an accessory, which in this embodiment of the invention is an earth moving bucket 7. The distal (free) end of the dipper arm 5 is adapted to enable attachment of accessories. A quick hitch coupler according to the invention and indicated generally by the reference numeral 14 releasably hitches the bucket 7 to the dipper arm 5. The quick hitch coupler 14 is described in detail below. A pair of boom operating rams 12 acting between the sub-chassis and the boom 4 operate the boom 4 for raising and lowering the boom 4 about its pivot connection to the sub-chassis. A dipper arm operating ram 8 acting between the boom 4 and the dipper arm 5 pivots the dipper arm 5 relative to the boom 4. The ram 8 controls the reach of the dipper arm 5 by controlling the angle of the dipper arm 5 relative to the boom 4. However the operation of a boom and dipper arm of such excavator apparatus will be well known to those skilled in the art, and it is not intended to describe this aspect of the invention further.

A pivotally mounted connecting linkage 18 is pivotally connected by a pair of pivot pins to the dipper arm 5 towards the distal end thereof. An accessory operating (or crowd)

ram 15 acting between the dipper arm 5 and the connecting linkage 18 is provided for pivoting the connecting linkage 18 for in turn pivoting the bucket 7 relative to the dipper arm 5. The angle of the coupler 14 relative to the arm 11 (and in particular relative to the dipper arm 5) is therefore controlled by the hydraulic ram 15, as is well known in the art.

A pair of coupling pins, namely, a first coupling pin and a second coupling pin (not shown) are provided on the bucket 7, or indeed, on any other accessory to be connected to the dipper arm 5, for engagement with the quick hitch coupler 14 as will be readily appreciated by those skilled in the art.

Referring to FIG. 2A, 2B, 3A and 3B, the safety coupling mechanism according to one embodiment of the invention comprises a body member or housing 20 formed by a pair of spaced apart side plates 21, 22. A base plate 23 lies between the side plates 21, 22. The side plates 21, 22 comprise an upper portion 24 and a lower portion 25. The lower portion 25 borders the safety mechanism 26. The upper portion 24 of each of the side plates 21, 22 comprises a connecting means 27 for connecting the coupler to a dipper arm 5 and the connecting linkages 18. The connecting means 27 comprises two pairs of bushed bores 28 and 29 one of each pair extending through each side plate 21, 22. The bushed bores 28, 29 in the side plates 21, 22 are aligned with each other for in turn aligning with the bushed bores in the connecting linkages 18 for engagement with the first coupling pin. The bushed bores 28, 29 in the respective side plates 21, 22 are aligned with each other for in turn alignment with the bushed bore through the dipper arm 5 for engagement with the second coupling pin. In this way the quick hitch coupler 14 is connected to the dipper arm 5 and the connecting linkages 18, and is thus pivotable about the second coupling pin by the connecting linkages 18 under the action of the accessory operating ram 15 for in turn pivoting the coupler 14 and any attached accessory.

Figure 4:
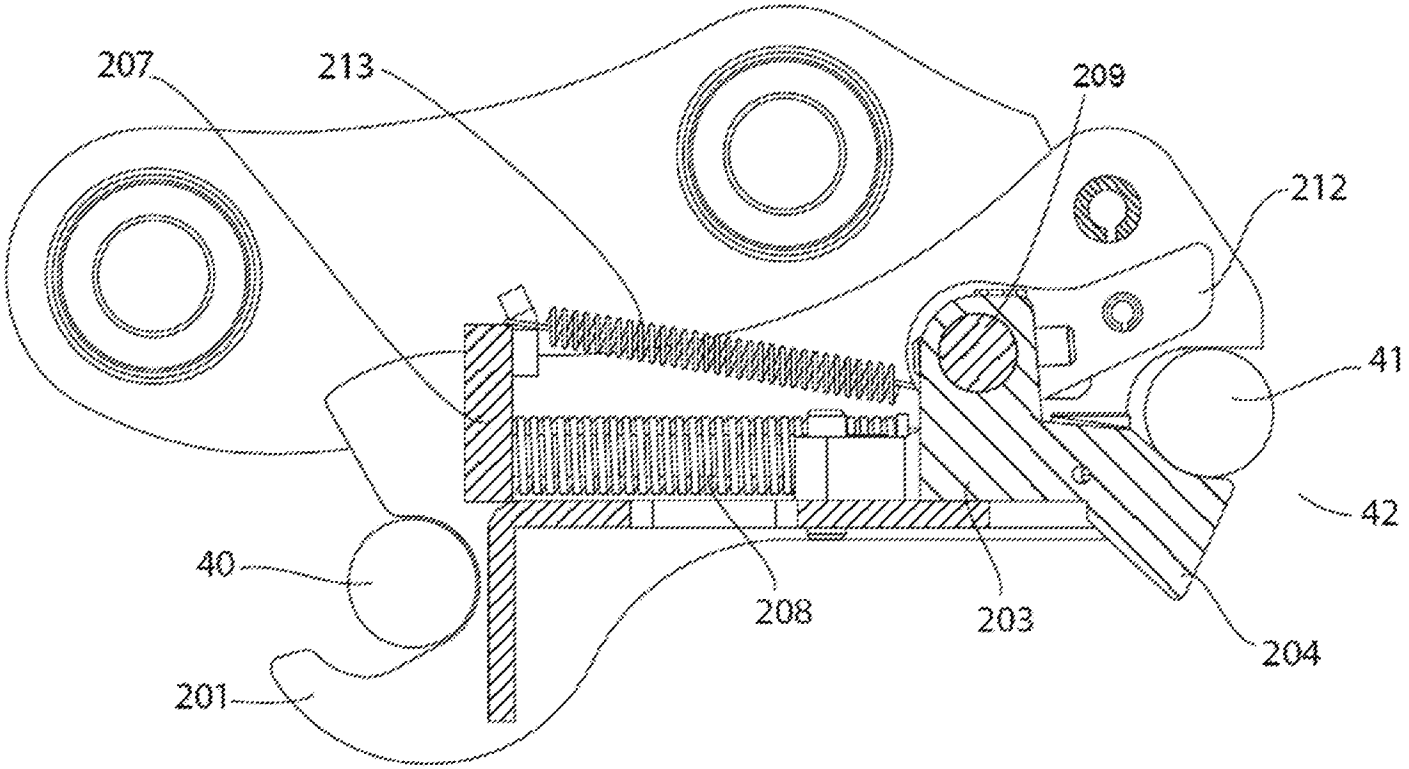
FIG. 4 is a cutaway view of the mechanism in the closed configuration with a pin in place in the clamping area.
Figure 5A:
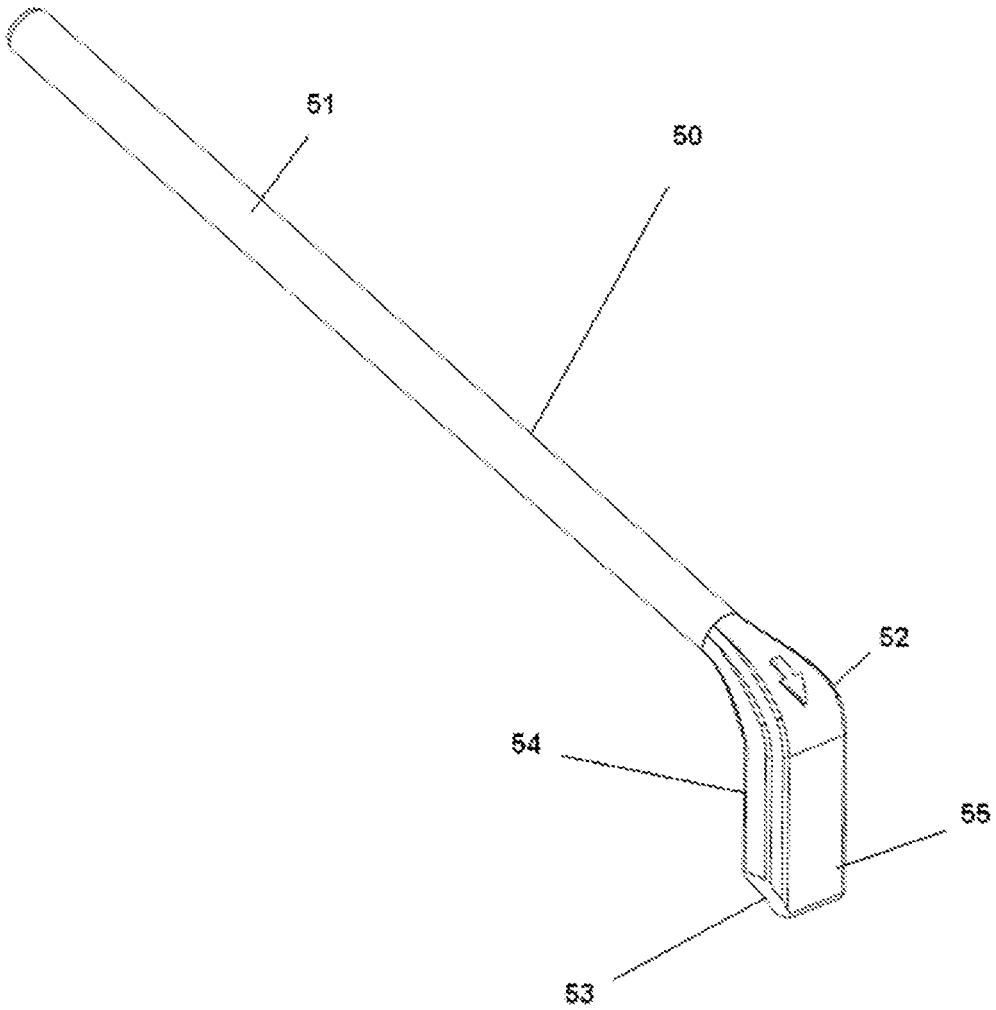
FIG. 5*a* is a perspective view of the release tool.
Figure 5B:
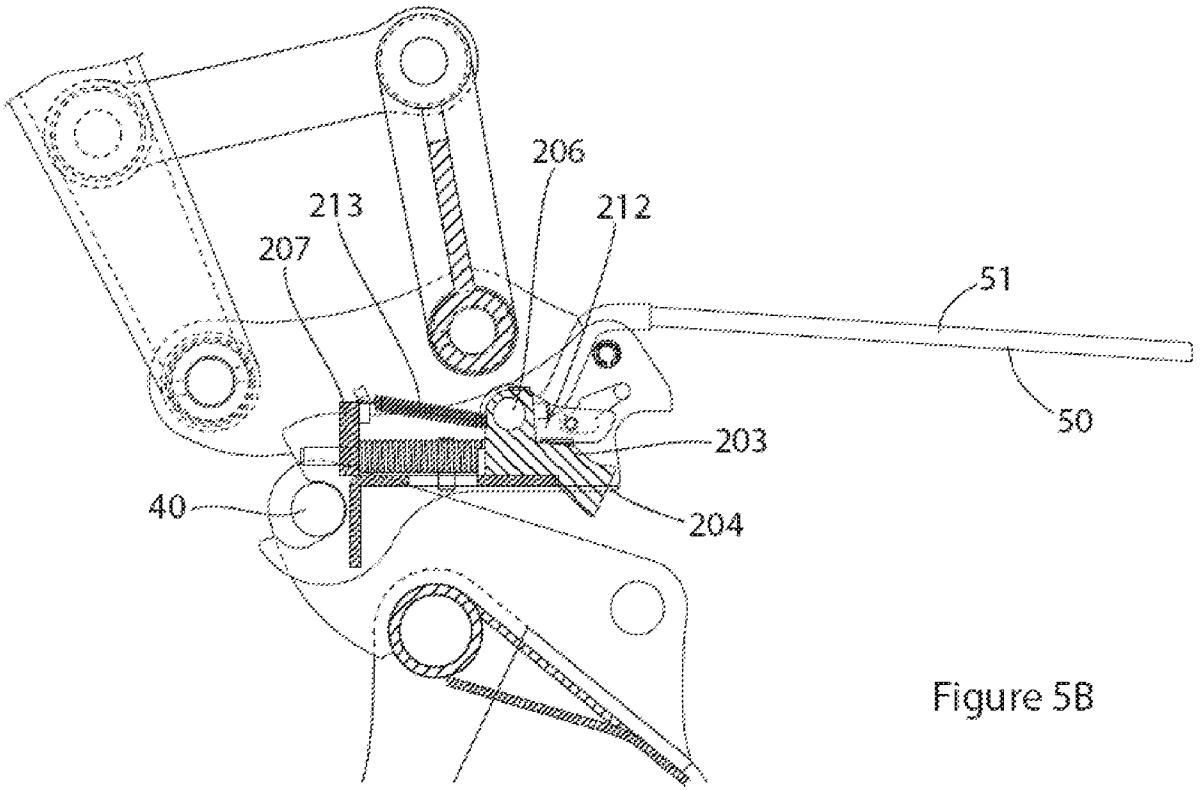
FIG. 5*b* is a cutaway view of the device in the fully open configuration with the release tool engaged and with the pin in a released position.

Each side plate 21, 22 further comprises a fixed pair of jaws defining a fixed open mouth 201, 30. The fixed mouths 201, 30 in each side plate are aligned with each other such that together they form a fixed engagement member for engaging a first coupling pin 40 (See FIG. 4) of an accessory. A moveable engaging means or engagement mechanism is provided by a moveable engagement element 202 slideably carried in the body member 20. The engagement element 202 comprises a wedge shaped engagement plate 203 and further comprises an engagement ramp 204 which protrudes from one end of the engagement plate. The engagement ramp 204 can be further seen in FIG. 4. The engagement plate 203 is slideable between a first state as illustrated in FIG. 5B for disengaging the second coupling pin 41 and for releasing the accessory from the coupler 14 and a second state as illustrated in FIG. 4 for engaging a second coupling pin 41 of an accessory. In the first state, the second coupling pin 41 is released. In the second state, the second coupling pin 41 is clamped between the engaging plate and a surface 32, 33 of the side plates 21, 22.

The engagement plate 203 may also be configured in a third state or intermediate state (FIG. 3A, 3B), between the first and the second state. In this third state, the engagement plate is positioned such that it is primed to receive a coupling pin of an attachment.

The transition between states and clamping of the second coupling pin will be later explained in further detail.

The base plate 23 comprises a channel 205 into which the engagement ramp 204 of the engagement plate 203 is moveable when the engagement plate 203 is slidably moved within the body member 20.

The engaging member 202 comprises an engaging plate 203 which is slideable over the base plate 23. The engaging plate 203 is slideable within recessed channels 215 in the lower part of the side plates 21, 22 of the body member 20. The engaging plate 203 may further comprise a protrusion 218 for providing protection to a grease nipple 222. The engaging element 202 further comprises a front wall 206, into which the safety mechanism 26 is integrated. A fixed back wall 207 is situated on the base plate 23 between the side plates 21, 22. A pair of springs 208 lie substantially horizontally along the top surface of the base plate 23 and connects between the rear surface of the front wall 206 and the front surface of the back wall 207. Two elongate members 217 are fixed to the rear surface of the front wall 206. The elongate members 217 extend through the coils of the springs 208. Compression of the springs 208 moves the front wall 206 of the engaging plate 203 towards the back wall 207 on the base plate 23. Compression of the springs 208 in this manner causes the elongate members 217 to protrude through two openings 62 in the back wall 207. This allows the elongate members 217 to act as a visual indicator 63 of the position of the engaging plate 203. Thus, if the members are visible through the back wall 207, it may be deduced that the spring 208 is in a compressed state.

The springs 208 are compressed by the action of a release tool 50 (FIG. 5A), which engages with the safety release mechanism 26 and which pivots about a pivot element 214, allowing it to act upon on the front wall 206 of the engaging element 202. Indicators 219 on the front wall 206 of the engaging element 202 act as a guide to operators using the release tool 50. The release tool 50 is substantially L shaped and comprises a handle 51 and a head element 52 for engaging with the safety release mechanism 26. The head element 52 further comprises a chamfered area 53 on one side of the head element 52.

The safety release mechanism 26 comprises a safety lock 220 which is integrated into the front wall 206 of the engaging member. The safety lock 220 is biased into a locked position. The safety lock 220 comprises a biased pin element 209 enclosed within the front wall 206 of the engaging member. The pin element is biased by means of a spring 216. The front wall 206 comprises an opening 210 through which access can be gained to the pin element 209. The pin element 209 comprises a protrusion 211 which extends through the opening 210 in the front wall element. The protrusion 211 allows for attaching of the pin element 209 to the release tool 50. In "locked" position, the pin element extends into a recess 31 on the inner face of one of the side plates 21. In an "unlocked" position, the pin is disengaged from the recess 31.

The safety release mechanism further comprises a link 212 which is pivotable about the safety lock 220 and is moveable with engaging plate 203. A tension spring 213 connecting between the back wall 207 and the link 212 provides a biasing force to the link. The link 212 has a pin 60 (FIG. 6) protruding into a slot 61 in the lower portion 25 of one of the side plates 22 of the device. The slot 61 is shaped such that it allows the link 212 to be maintained in an upper position, with the pin 60 in position B (in which a pin of an attachment may be held in the clamping area 42) and a lower position, with the pin in position A, (in which a pin of an attachment has been released from the clamping area 42 and in which the clamping area 42 is open to receiving a pin from another attachment if required).

The operation of the device will now be described.

Releasing an Attachment

With an attachment in place, the device is in a closed configuration (FIG. 4). With the device in the closed configuration, a first coupling pin 40 of an accessory is held in the fixed open mouth 201, 30 of the device. A second coupling pin 41 of an accessory is retained in the clamping area 42 of the device. The clamping area 42 defines the region comprising the engagement plate 203 and the engagement ramp 204 into which the second coupling pin 41 of an accessory may enter in order to engage with the device. With the device in the closed configuration, the link 212 is in the upper position. The protrusion 63 does not protrude through the back wall 207 of the engaging member. The pin 209 of the safety lock 220 is in the locked position. In this position, the pin element 209 is engaged in a recess 31 on the inner face of one of the side plates 21. With the pin 209 in this position, slideable movement of the engagement plate 203 across the base plate 23 is prevented.

The release tool 50 (FIG. 5A) may be used to disengage the safety release mechanism 26 by causing the pin element 209 to be removed from the recess 31 thus allowing slideable movement of the engagement plate.

The release tool 50 is engaged with the safety release mechanism 26 by inserting the head element 52 in to the region above the pivot element 214 such that the head element is facing downwards towards the engagement plate 203 (FIG. 5B). The head element 52 is then pushed downwards such that the inner face 54 of the head element faces the inner surface 221 of the pivot element 214 and the outer face 55 of the head element faces the front wall 206 of the engaging element 202. As the head element 52 is pushed downwards between the pivot element 214 and the front wall 206, the chamfered area 53 of the head element engages with the protrusion 211 on the pin 209 of the of the safety lock 220. Further application of a downward force on the head element 52 causes a lateral force to be applied to the protrusion 211 by the chamfered area 53 of the head element in the direction of the side plate 22 and allows for the pin 209 to be retracted from the recess 31 (See FIG. 2B).

Figure 6:
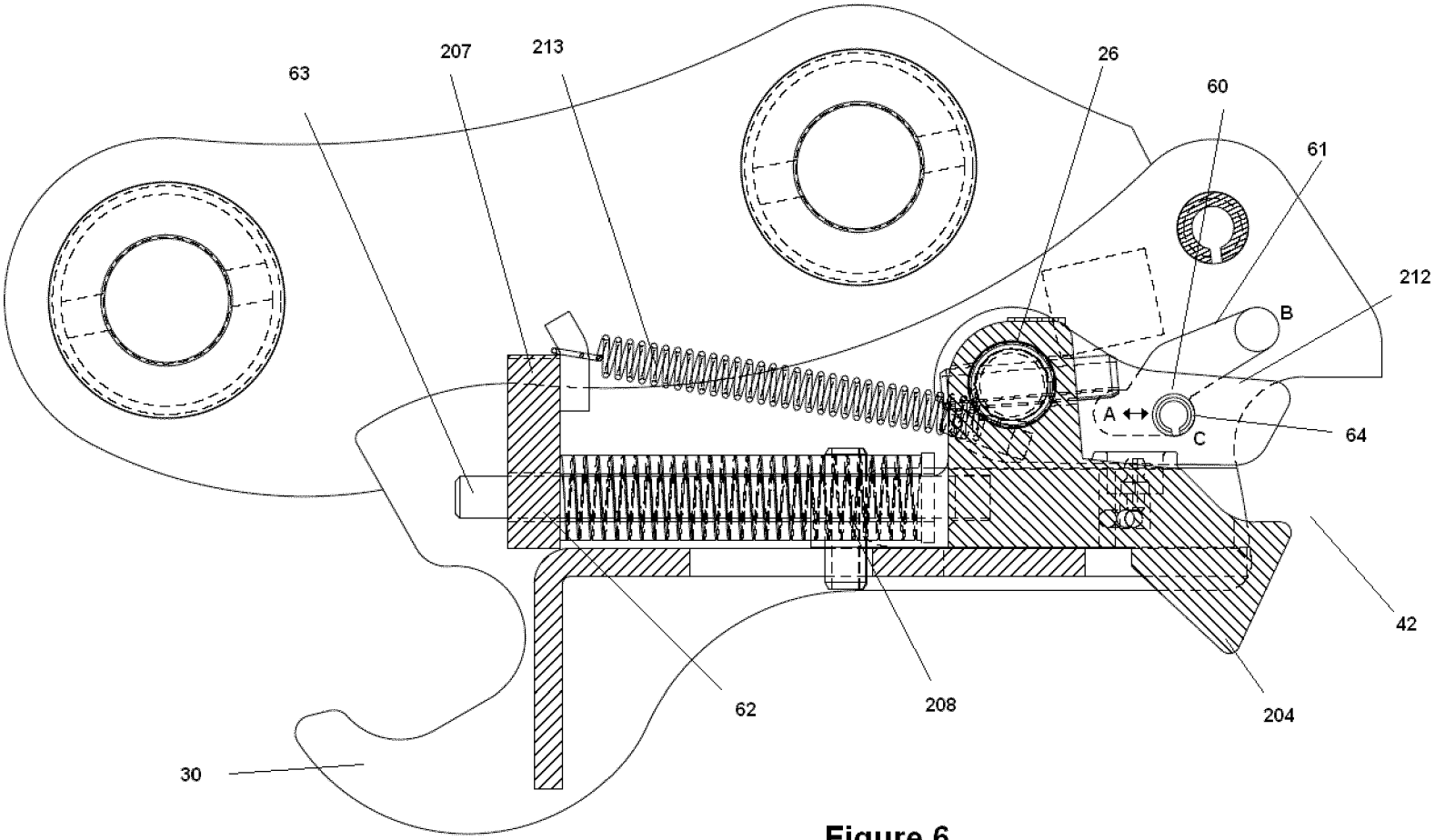
FIG. 6 is a cutaway view of the mechanism in a partially open configuration with the release tool disengaged.

With the release tool 50 in position with the head element 52 between the pivot element 214 and the front wall 206 and with the pin 209 retracted, applying a manual force downward on the handle 51 of the release tool will cause the release tool to pivot about the pivot element 214, causing the outer face 55 of the release tool to be pressed against the front wall 206 of the engaging element 202 (FIG. 5B). This action forces the engaging plate 203 to move slideably in the direction of the back wall 207. It further causes the springs 208 to compress. Furthermore, when the engaging plate 203 is moved in the direction of the back wall 207, the action of the spring 213 will cause the link 212 to be biased to a lower position, with the pin 60 in position A (FIG. 6). This is the first state referred to above.

With the engaging plate 203 pushed back, the second coupling pin 41 can no longer be retained in the clamping area between the engaging plate and the surface 32, 33 of the side plates 21, 22. This releases the coupling pin 41 from the clamping area 42.

Removing the manual force from the release tool 50 allows the engaging plate 203 to move forward towards the clamping area 42. This device is thus in a partially open configuration. With the device 203 in the partially open configuration, the link 212 remains a lower position. The link 212 is held in this lower position as the pin 60 is held in position C (FIG. 6), thus prevents further movement of the link 212 by stopping against a surface wall 64 of the slot 61. This prevents the engaging plate 203 from moving further towards the clamping area and further prevents the pin 209 of the safety lock 220 from re-engaging with the recess 31.

The release tool 50 may be removed and the engaging plate 203 will thus remain in the partially open configuration described. This is the third state referred to above.

With the engaging plate in the open or partially open configuration, an attachment connected to the device is now only connected by the first coupling pin 40. The attachment may thus hang freely about coupling pin 40 on the fixed open mouth (201, 30). By manoeuvring of the excavator, an operator can now remove the attachment from the coupler by removing pin 40 from the fixed open mouth.

Engaging and Retaining an Attachment

Before engaging an attachment the operator must ensure that the device is in a suitable configuration i.e. that the pin 60 of link 212 is pressed against the surface wall 64 of slot 61 (FIG. 6). With the device in this configuration, the indicator 63 can be seen from the cab in the main housing 2 of the excavator and when the indicator is protruding through the back wall 207 of the engaging member, the operator may deduce that the device is ready to pick up an attachment. An attachment may be engaged to the device as follows:

An operator uses the excavator to pick up the first coupling pin 40 of the attachment with the fixed open mouth 201, 30. By control of the dipper arm 5 and ram 15 of the excavator, an operator can rotate the coupler inwards so that the second coupling pin 41 of the attachment will move towards the engagement ramp 204.

The operator can manoeuvre the dipper arm 5 of the excavator to push engagement ramp 204 against the second coupling pin 41. This action has the effect of forcing the engaging plate 203 back against the springs 208. This action allows the second coupling pin 41 of the attachment into the clamping area 42. As the engaging plate 203 moves back towards the back wall 207, the pin 60 on the link 212 is moved away from the surface wall 64 of slot 61 towards position A (FIG. 6). When pin 41 enters clamping area 42 the springs 208 push the engaging plate 203 forward toward pin 41. As engaging plate 203 moves forward towards the coupling pin 41, the pin 41 will bias link 212 into its upper position, guiding pin 60 away from the surface wall 64 towards position B. The engaging plate 203 can now clamp around second coupling pin 41 of the attachment in the clamping area 42. Thus, the second coupling pin 41 may be clamped between the engaging plate and the surface 32, 33 (FIG. 3B) of the side plates 21, 22, thus retaining the coupling pin.

When the engaging plate 203 clamps the second coupling pin 41, the pin element 209 of the safety lock 220 will engage in the recess 31 on the inner face of one of the side plates 21 of the device. This has the effect of securing the engaging plate 203 in the closed configuration and thus securely retaining the second coupling pin 41. This is the second state referred to above.

If there is no pin 41 in the clamping area, the link 212 will remain in the lower position with the pin 60 in position C, thus preventing the engaging plate from moving sufficiently into the clamping area to allow the safety lock 220 to engage in the recess 31.

Figure 7:
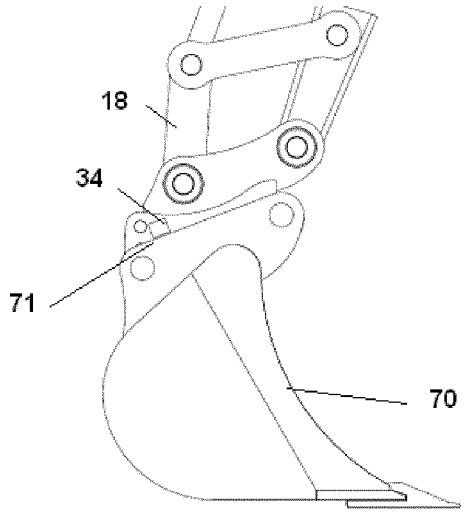
FIG. 7 is a side view of the mechanism with an attachment connected.
Figure 8:
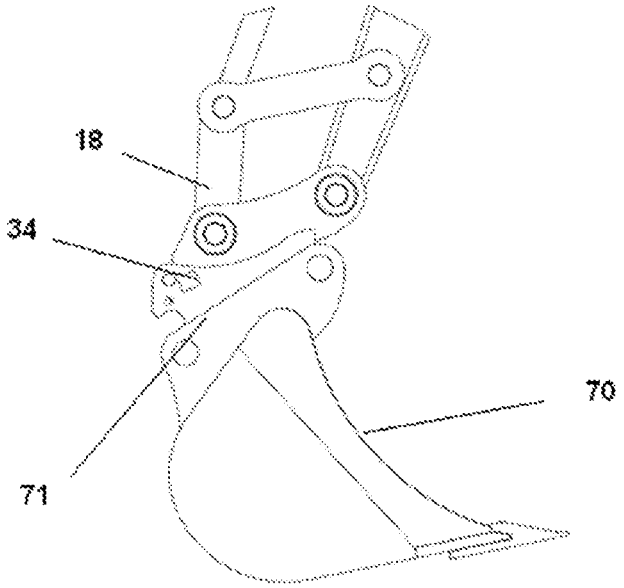
FIG. 8 is a side view of the mechanism with the attachment not fully connected.

Visual aids 34, 63 are provided to the operator of the excavator to confirm that the attachment is secured to the coupler. The indicator 63 should not protrude through the back wall 207 when the attachment is secured. An additional visual aid is provided on the outer wall of one of the side plates 22. This aid takes the form of an additional indicator 34 in the form of a protrusion on the outer wall. The protrusion may be cube shaped or any suitable shaped to provide a surface which can be visually inspected with respect to an attachment surface. The relative position of the indicator 34 surface and the attachment surface provide a user with an indication of whether an attachment is secured in place. For example, if the indicator 34 is no more than 10 mm from the top surface 71 of the attachment 70, then the operator can deduce that the attachment 70 is properly connected to the coupler (FIG. 7, 8).

While the above embodiment describes the use of the device in conjunction with coupling pin connections on attachments, the device is further suitable for use with further types of attachment retaining elements, for example male and female type retaining elements.

The words "comprises/comprising" and the words "having/including" when used herein with reference to the present invention are used to specify the presence of stated features, integers, steps or components but does not preclude the presence or addition of one or more other features, integers, steps, components or groups thereof.

Having described the invention, the following is claimed:

1. An excavator tool attaching mechanism comprising:
- a housing comprising a pair of housing walls;
- a fixed engagement member for engaging with a first coupling pin of an excavator tool;
- a moveable engagement mechanism for engaging with a second coupling pin of the excavator tool;
- an engaging element of the moveable engagement mechanism moveable between a first position for disengaging from the second coupling pin and thereby releasing the excavator tool and a second position for engagement with the second coupling pin of the excavator tool;
- a safely mechanism, formed integrally with the engaging element, wherein the safety mechanism is configured to automatically move from an unlocked configuration to a locked configuration by movement of the engaging element from the first position to the second position, preventing movement of the engaging element between the second and first position; and
- a release tool, engageable with the moveable engagement mechanism and the safety mechanism, for moving the engaging element to a third position between the second and first positions, further comprising a pin for holding the engaging element in the third position to prevent the engaging element from moving between the first position and the second position.

2. The attaching mechanism of claim 1 further comprising a ramp element fixed to the engaging element.

3. The attaching mechanism of claim 2, wherein the engaging element is moveable between the first position and the second position by engagement of the ramp element with the second coupling pin of the excavator tool.

4. The attaching mechanism of claim 1, wherein the engaging element comprises an engagement plate slideable between the housing walls.

5. The attaching mechanism of claim 4, wherein the engaging element further comprises a raised portion on the engagement plate.

6. The attaching mechanism of claim 5, wherein the safety mechanism is housed within the raised portion on the engagement plate.

7. The attaching mechanism of claim 1, wherein the safety mechanism is housed within the engaging element of the movable engagement mechanism.

8. The attaching mechanism of claim 1, wherein the safety mechanism further comprises a biased pin engagable with one of the pair of housing walls.

9. The attaching mechanism of claim 8, wherein the biased pin is accessible through an opening in the engaging element.

10. The attaching mechanism of claim 9, wherein the pin is accessible through an opening in a raised portion of the engaging element.

11. The attaching mechanism of claim 1, wherein the pin comprises a biased link on the engaging element of the moveable engagement mechanism which engages with a recess in one of the housing walls.

12. The attaching mechanism of claim 11, wherein the biased link is biased by means of a tension spring.

13. The attaching mechanism of claim 1, wherein the attaching mechanism further comprises an indicator for indicating the position of the engaging element.

14. The attaching mechanism of claim 1, wherein the attaching mechanism is incorporated into a coupling device for coupling an excavator tool to an arm.

15. An excavator arm comprising:
- an excavator tool attaching mechanism including:
  - a housing comprising a pair of housing walls;
  - a fixed engagement member for engaging with a first coupling pin of an excavator tool;
  - a moveable engagement mechanism for engaging with a second coupling pin of the excavator tool;
  - an engaging element of the moveable engagement mechanism moveable between a first position for disengaging from the second coupling pin and thereby releasing the excavator tool and a second position for engagement with the second coupling pin of the excavator tool;
  - a safety mechanism, formed integrally with the engaging element, wherein the safety mechanism is configured to automatically move from an unlocked configuration to a locked configuration by movement of the engaging element from the first position to the second position, preventing movement of the engaging element between the second and first position; and
  - a release tool, engageable with the moveable engagement mechanism and the safety mechanism, for moving the engaging element to a third position between the second and first positions, further comprising a pin for holding the engaging element in the third position to prevent the engaging element from moving between the first position and the second position.

16. An excavator comprising:
- an excavator arm comprised of:
  - an excavator tool attaching mechanism including:
    - a housing comprising a pair of housing walls;
    - a fixed engagement member for engaging with a first retaining element of an excavator tool;
    - a moveable engagement mechanism for engaging with a second retaining element of the excavator tool;
    - an engaging element of the moveable engagement mechanism moveable between a first position for disengaging from the second retaining element and thereby releasing the excavator tool and a second position for engagement with the second retaining element of the excavator tool;
    - a safety mechanism, formed integrally with the engaging element, wherein the safety mechanism is configured to automatically move from an unlocked configuration to the locked configuration by movement of the engaging element from the first position to the second position, preventing movement of the engaging element between the second and first position; and a release tool, engageable with the moveable engagement mechanism and the safety mechanism, for moving the engaging element to a third position between the second and first positions, further comprising a pin for holding the engaging element in the third position to prevent the engaging element from moving between the first position and the second position.

* * * * *